US009957760B2

(12) United States Patent
Watters et al.

(10) Patent No.: US 9,957,760 B2
(45) Date of Patent: May 1, 2018

(54) FRICTIONAL SUPPORT OF SEAL BORE PROTECTOR

(71) Applicant: Halliburton Energy Services, Inc., Houston, TX (US)

(72) Inventors: Travis David Watters, Flower Mound, TX (US); Owen Ransom Clark, Dallas, TX (US); Joseph Michael Karigan, Carrollton, TX (US); Anton Kelley Arnt, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days. days.

(21) Appl. No.: 15/503,341

(22) PCT Filed: Sep. 8, 2015

(86) PCT No.: PCT/US2015/048987

§ 371 (c)(1),
(2) Date: Feb. 10, 2017

(87) PCT Pub. No.: WO2016/040348

PCT Pub. Date: Mar. 17, 2016

(65) Prior Publication Data

US 2017/0226809 A1 Aug. 10, 2017

Related U.S. Application Data

(60) Provisional application No. 62/049,018, filed on Sep. 11, 2014.

(51) Int. Cl.
*E21B 17/10* (2006.01)
*E21B 33/035* (2006.01)
(Continued)

(52) U.S. Cl.
CPC ..... *E21B 17/1064* (2013.01); *E21B 33/068* (2013.01); *E21B 17/10* (2013.01);
(Continued)

(58) Field of Classification Search
CPC .. E21B 17/10; E21B 17/1007; E21B 17/1064; E21B 33/068; E21B 33/085; E21B 2033/005
See application file for complete search history.

(56) References Cited

U.S. PATENT DOCUMENTS 7,644,757 B2 * 1/2010 Artherholt ..... E21B 33/04 166/113
7,823,634 B2 * 11/2010 Chan ..... E21B 43/26 166/80.1
(Continued)

FOREIGN PATENT DOCUMENTS

WO 2008120025 A2 10/2008

OTHER PUBLICATIONS

International Search Report and Written Opinion dated Jan. 14, 2016; International PCT Application No. PCT/US2015/048987.

*Primary Examiner* — Matthew R Buck
(74) *Attorney, Agent, or Firm* — McGuireWoods LLP

(57) ABSTRACT

A seal bore protector for protecting a seal bore of a rotating control device (RCD) is provided. The seal bore protector includes a cylindrical body, a throughbore extending through the cylindrical body, and a sealing element disposed around an external surface of the cylindrical body. The sealing element includes a first sealing ring, a second sealing ring, and a sealed area between the first sealing ring and the second sealing ring. The sealed area is fluidly coupled with a port when the seal bore protector is installed in the rotating control device.

17 Claims, 6 Drawing Sheets

(51) Int. Cl.
*E21B 33/068* (2006.01)
*E21B 33/00* (2006.01)
*E21B 33/08* (2006.01)

(52) U.S. Cl.
CPC ..... *E21B 33/035* (2013.01); *E21B 33/085* (2013.01); *E21B 2033/005* (2013.01)

(56) References Cited

U.S. PATENT DOCUMENTS

| | | | | |
|---|---|---|---|---|
| 7,926,593 | B2 * | 4/2011 | Bailey | E21B 21/08 166/338 |
| 8,322,441 | B2 * | 12/2012 | Fenton | E21B 17/1007 166/339 |
| 8,443,898 | B1 * | 5/2013 | McClinton | E21B 17/1007 166/337 |
| 8,727,012 | B2 * | 5/2014 | Bhat | E21B 33/035 166/338 |
| 2004/0200614 | A1 | 10/2004 | Stjernstrom et al. | |
| 2008/0105462 | A1 * | 5/2008 | May | E21B 33/085 175/7 |
| 2010/0051261 | A1 * | 3/2010 | Koleilat | E21B 33/068 166/177.5 |
| 2014/0034328 | A1 | 2/2014 | Smith et al. | |

* cited by examiner

FRICTIONAL SUPPORT OF SEAL BORE PROTECTOR

BACKGROUND

1. Technical Field

The present disclosure relates to oil and gas exploration and production, and more particularly to a rotating control device (RCD) that includes a removable rotating bearing assembly.

2. Description of Related Art

Wells are drilled using a drill string to access and produce oil, gas, minerals, and other naturally-occurring deposits from subterranean geological formations. A rotating control can be used in a variety of oil and gas operations including drilling operations in conjunction with the drill string. For example, a rotating control device may be used for a variety of applications including annular fluid containment and pressure management in onshore and offshore drilling environments. RCDs provide annular fluid containment and pressure management by creating a pressure-tight barrier in a wellbore annulus that enables safe fluid containment and diversion creating a closed-loop drilling environment.

The RCD can include an outer stationary body and a removable inner rotating bearing assembly that rotates along with a drill string during drilling operations while maintaining the pressure-tight barrier. The rotating control device may operate similarly with other rotating tool strings. The bearing assembly provides for the rotation of a rotational component that rotates within the outer stationary component or body and may form a sealed interface with a tool string that runs through the rotating control device.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF ILLUSTRATIVE EMBODIMENTS

Figure 1A:
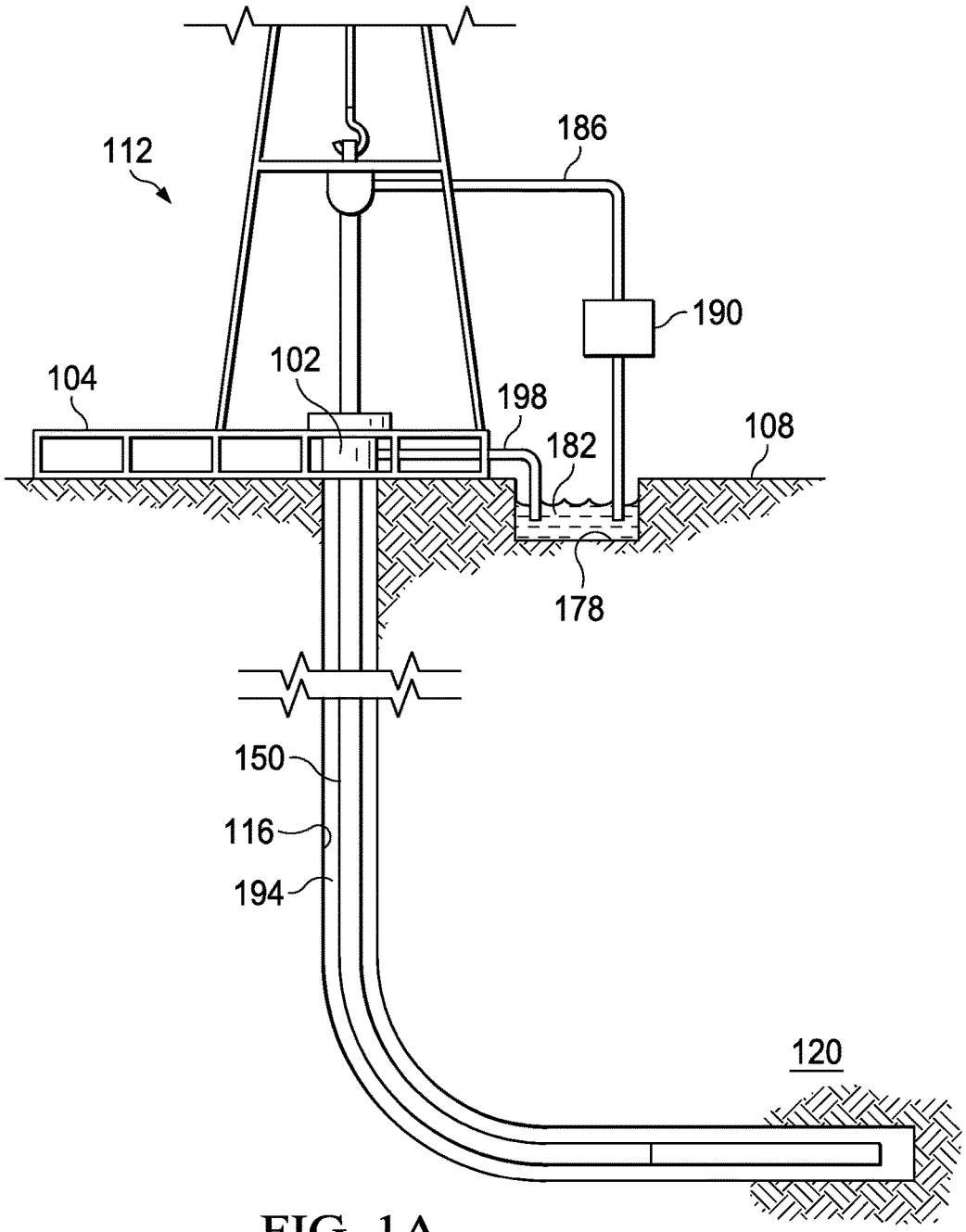
FIG. 1A is a schematic view of an onshore well in which a rotating control device (RCD) is deployed.

In the following detailed description of the illustrative embodiments, reference is made to the accompanying drawings that form a part thereof and is provided to assist the reader in gaining a comprehensive understanding of the methods, apparatuses, and/or systems described herein. These embodiments are described in sufficient detail to enable those skilled in the art to practice the invention, and it is understood that other embodiments may be utilized and that logical structural, mechanical, electrical, and chemical changes may be made without departing from the spirit or scope of the invention. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order.

To avoid detail not necessary to enable those skilled in the art to practice the embodiments described herein, the description may omit certain information known to those skilled in the art. Also, the respective descriptions of well known functions and constructions may be omitted for increased clarity and conciseness. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion and thus should be interpreted to mean "including, but not limited to." Unless otherwise indicated, as used throughout this document, "or" does not require mutual exclusivity.

During certain well operations, additional components may need added to a drill string and tripped downhole. In some instances, however, a rotating control device may be installed at or near the well head that does not provide for adequate space for inserting the components into the wellbore. In order to provide space for the additional components, the rotating control device can be disengaged and the rotating bearing assembly may be removed to provide additional clearance.

When the bearing assembly is removed, however, an inner surface of a stationary portion of the rotating control device may be exposed to the components as being sent downhole, which may in turn increase the likelihood of damage to an inner surface of the outer stationary portion or body of the rotating control device. More particularly, a seal bore protector is provided herein that replaces the removed rotating bearing assembly, covers the inner surface of the outer stationary component, and protects that inner surface from the components being tripped downhole.

The present disclosure relates generally to a seal bore protector that includes sealing elements used to secure the seal bore protector in a rotating control device (RCD). The sealing elements may be made from an elastomeric material, and positioned within the body of the rotating control device such that, when select fluid ports of the rotating control device are actuated, compartments formed at least in part by the sealing elements will become pressurized, resulting in engagement between the sealing elements and body of the rotating control device to the seal bore protector in place.

Turning now to the figures, FIG. 1A illustrates a schematic view of a rig 104 operating a rotating control device 102 that diverts a fluid traveling through an annulus 194 according to an illustrative embodiment. As described in more detail below The rotating control device may include a seal bore protector. Rig 104 is positioned at a surface 108 of a well 112. The well 112 includes a wellbore 116 that extends from the surface 108 of the well 112 to a subterranean formation 120. The well 112 and rig 104 are illustrated onshore in FIG. 1A.

Figure 1B:
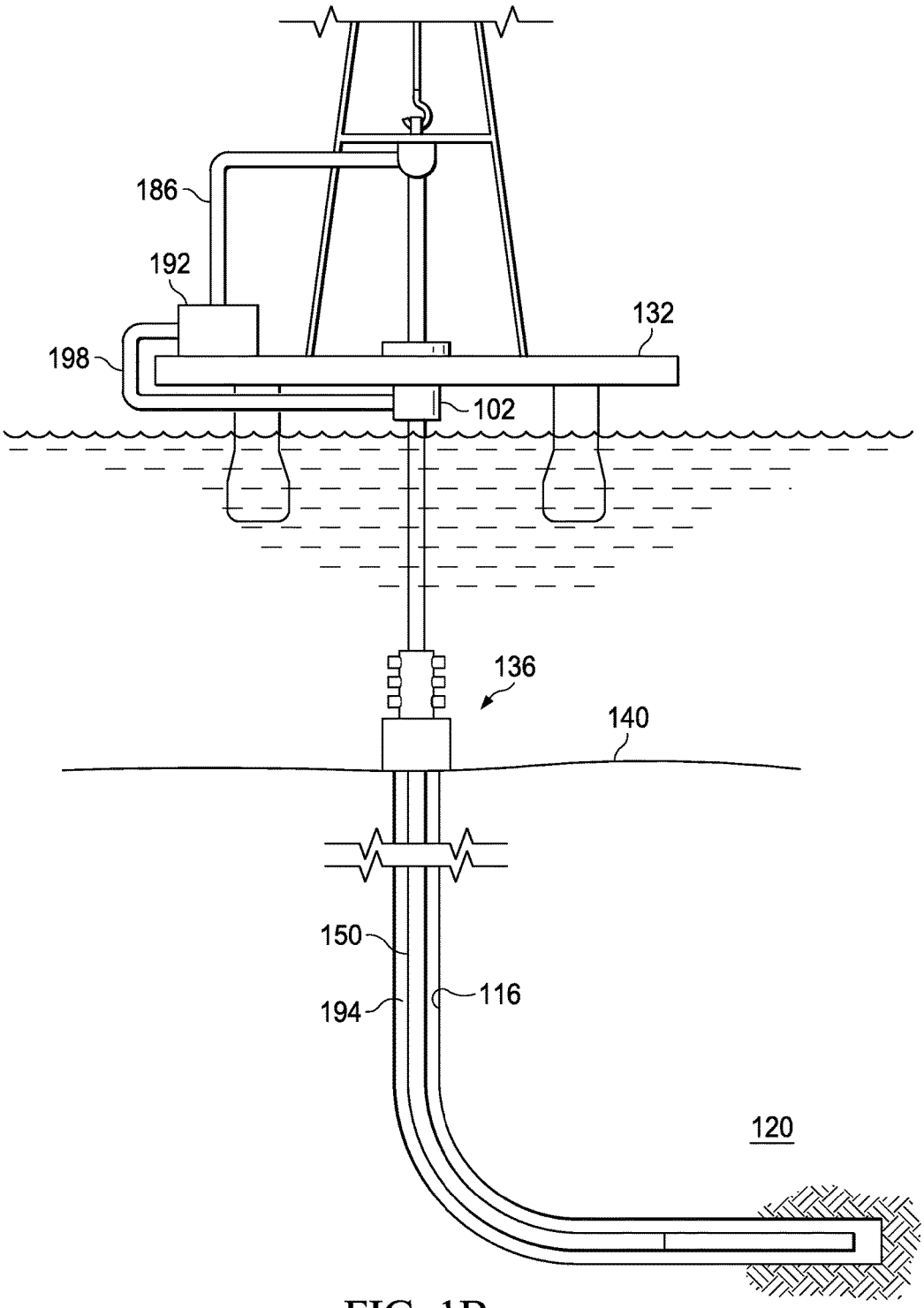
FIG. 1B is a schematic view of an offshore well in which a rotating control device is deployed.

Alternatively, FIG. 1B illustrates a schematic view of an offshore platform 132 operating a rotating control device 102 according to an illustrative embodiment. The rotating control device in FIG. 1B may be deployed at a proximal end of a sub-sea well 136 above the blowout preventer accessed by the offshore platform 132. The offshore platform 132 may be a floating platform or may instead be anchored to a seabed 140.

FIGS. 1A-1B each illustrate possible uses or deployments of the rotating control device 102, and while the following description of the rotating control device 102 primarily focuses on the use of the rotating control device 102 during the drilling, completion, and production stages, the rotating control device 102 also may be used in other stages of well formation and operation where it may be desired to provide annular fluid containment and diversion and pressure management.

In the embodiments illustrated in FIGS. 1A and 1B, the wellbore 116 is formed by a drilling process in which dirt, rock, and other subterranean material is removed to create the wellbore 116. During or after the drilling process a portion of the wellbore may be cased with a casing (not illustrated in FIGS. 1A and 1B). In other embodiments, the wellbore 116 may be maintained in an open-hole configuration without a casing. The embodiments described herein are applicable to either cased or open-hole configurations of the wellbore 116, or a combination of cased and open-hole configurations in a particular wellbore.

To form the wellbore 116, a drill string, shown as tool string 150, is operated to remove material from the subterranean formation 120. Drilling fluid travels down through the drill string and returns through the annulus 194 reaching the rotating control device 102. The rotating control device 102 contains the drilling fluid and diverts the drilling fluid into a return line 198 which is part of a closed-loop fluid circulation system that includes rotating control device 102 and the return line 198 that feeds into a reservoir 178. A pump 190 pulls from the reservoir 178 into a supply line 186. The supply line 186 provides fluid back to the drill string and through the rotating control device 102 to again be used downhole during drilling.

The closed-loop fluid circulation is shown in FIG. 1B as including the rotating control device 102 connected to the return line 198 that feeds into a pump and reservoir 192. The pump and reservoir 192 pass the fluid through the supply line 186, which recirculates back around into the drill string.

During drilling, additional tubing and/or equipment may be added to the drill string and passed downhole into the wellbore 116 through the rotating control device 102. In some instances, tubing and/or equipment may be too large to fit through the bearing assembly of the rotating control device 102. In such instances, an internal portion of the rotating control device 102 or bearing assembly is removed to provide additional clearance. In other instances, the rotating bearing assembly may be removed because it is not in use. For example, the rotating bearing assembly may be removed to accommodate overbalanced drilling. To protect the inside surface of the rotating control device 102 when the bearing assembly, or a portion of the bearing assembly is removed, a seal bore protector is installed in place of the rotating bearing assembly. The seal bore protector provides an unsealed interface through which tubing and/or equipment can pass through, and increased throughbore, as compared to the bearing assembly, and an interior surface that is more resistant to wear than the interior sealing surface (the seal bore) of the outer stationary component of the rotating control device (as described in more detail below).

In the embodiment shown in FIG. 1A, the reservoir 178 may be positioned at the surface 108 to hold a fluid 182 for delivery to the well 112 during normal drilling operations using the rotating control device 102 that handles the returning fluid 182 in the annulus 194. A supply line 186 is fluidly coupled between the reservoir 178 and the rotating control device 102 that is connected to the tool string 150. A pump 190 drives the fluid 182 through the supply line 186 back to the rotating control device 102 and through the tool string 150 toward a downhole location. The fluid 182 may also be used to carry out debris from the wellbore prior to or during the completion process. After traveling downhole, the fluid 182 or portions thereof returns to the surface 108 by way of the tool string 150 and/or annulus 194. At the surface 108, the fluid 182 may be returned to the reservoir 178 by the rotating control device 102 through a return line 198. The fluid 182 may be filtered or otherwise processed prior to recirculation through the well 112.

Figure 2:
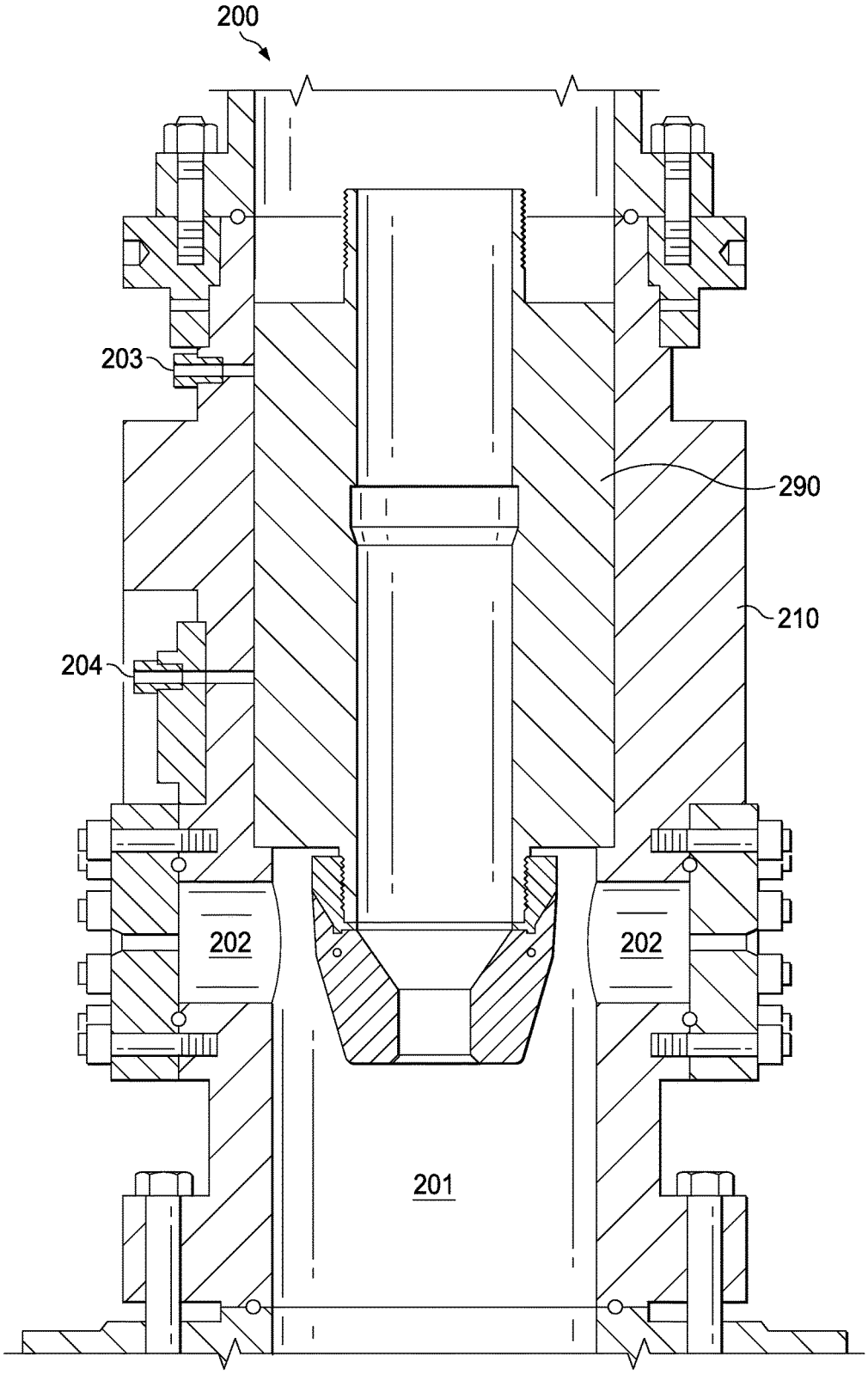
FIG. 2 is a schematic, cross-section view of a rotating control device with a removable inner rotating bearing assembly installed.

FIG. 2 shows an embodiment of a rotating control device 200 that includes a removable inner rotating bearing assembly 290 installed within an outer stationary body 210 of the rotating control device 200. The outer stationary body 210 may be a pressure shell. During drilling operations, drilling fluid being circulated through the well may flow uphole toward a throughbore 201 of the rotating control device 200, where it is diverted through outlets 202 that are connected to, for example, a return line 198 as shown in FIGS. 1A and 1B.

The rotating bearing assembly 290 of the rotating control device 200 is configured to rotate along with a drill string that passes through the rotating bearing assembly 290 while maintaining a sealed interface between the wellbore and external environment. During drilling or other well operations, multiple ports 203, 204 can be used to provide cooling fluid and/or hydraulic fluid to the rotating bearing assembly 290 or to an annulus between the rotating bearing assembly 290 and outer stationary body 210 to prevent overheating and to reduce wear. As such, the outer stationary body 210 includes a first hydraulic port 203, which may be a cooling fluid inlet and a second hydraulic port 204, which may be a cooling fluid outlet. The first hydraulic port 203 and second hydraulic port 204 are generally operated to provide and remove cooling fluid adjacent the bearing assembly 290. The outer stationary body 210 may include additional ports, such as a pressure monitoring port and a well bore port, that are used during well operations. The first hydraulic port 203 and second hydraulic port 204 may be alternatively operated as the pressure monitoring port and the well bore port. In some instances, additional clearance through the rotating control device 200 may be desired to allow for attaching and tripping tooling downhole. With the bearing assembly 290 in place, however, such additional clearance may not be available.

Figure 3:
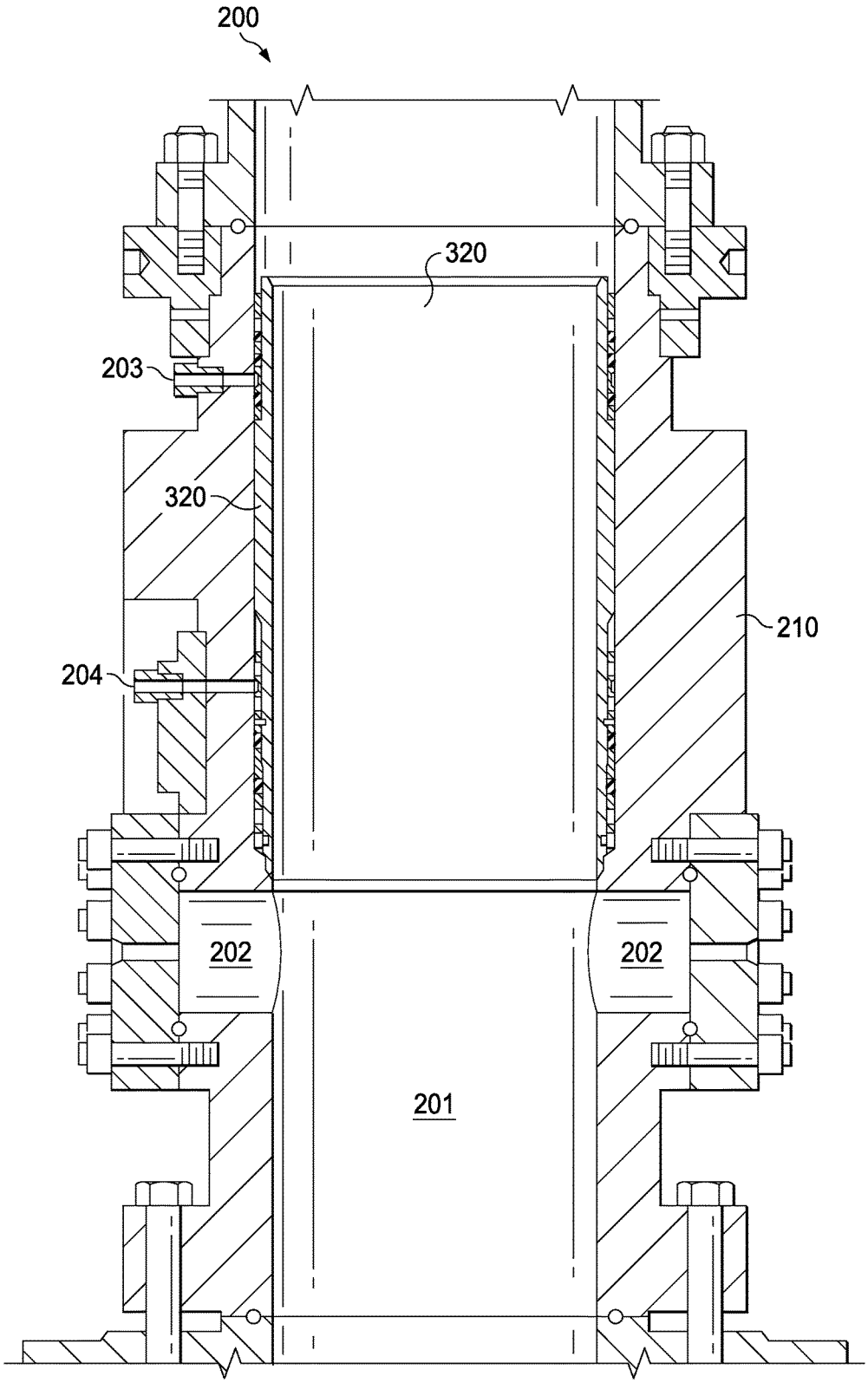
FIG. 3 is a schematic, cross-section view of a portion of a rotating control device with the removable inner rotating bearing assembly removed and a seal bore protector installed in its place, in accordance with an illustrative embodiment.

Accordingly, FIG. 3 shows the rotating control device 200 in an alternative configuration in which the rotating bearing assembly has been removed and replaced with a seal bore protector 320. The seal bore protector 320 is positioned inside of the outer stationary body 210 of the rotating control device 200. The seal bore protector 320 is configured such that, when placed within the rotating control device 200, sealing elements of the seal bore protector 320 are positioned on either side of each of the first hydraulic port 203 and second hydraulic port 204.

Figure 4:
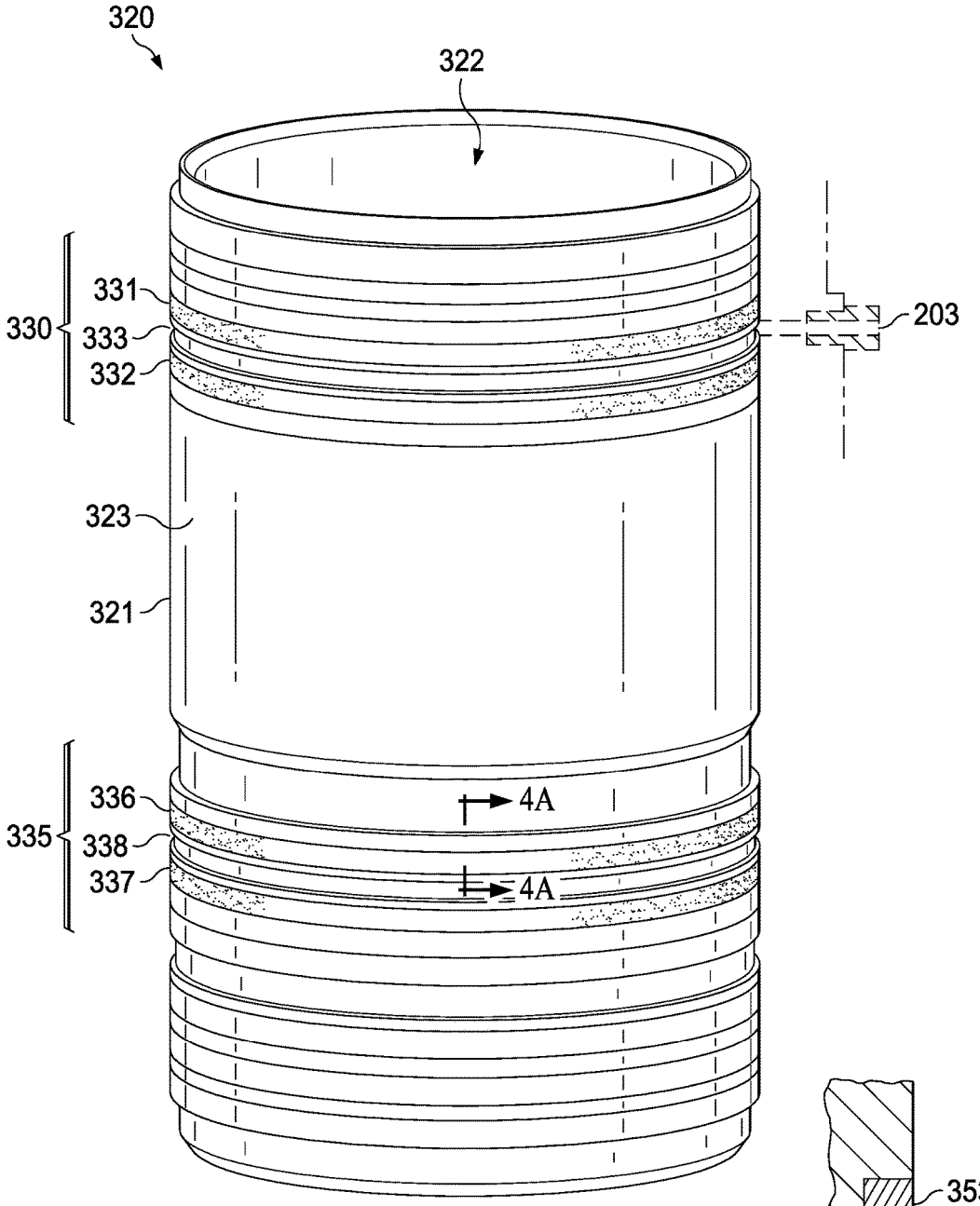
FIG. 4 is a schematic, perspective view of a seal bore protector similar to that shown installed in FIG. 3.

The seal bore protector 320 is shown in more detail in FIG. 4. The seal bore protector 320 includes a cylindrical body 321. A throughbore 322 extends through the cylindrical body 321. The cylindrical body 321 of the seal bore protector 320 may be made from any suitable material and may be, for example, tool steel.

The seal bore protector 320 further includes a sealing element 330 disposed about the circumference of an external surface 323 of the cylindrical body 321. The seal bore protector 320 may also include at least one additional sealing element 335 disposed around the external surface 323 of the cylindrical body 321. In other embodiments the seal bore protector 320 may have a plurality of other sealing elements disposed about the external surface 323. The sealing elements 330, 335 may be made from any suitable material and may be, for example, made from an elastomeric material. The sealing elements 330, 335 may be configured to expand and provide an enhanced gripping force when actuated, as described in more detail below.

The sealing element 330 includes a first sealing ring 331 and a second sealing ring 332. A recessed area 333, or groove, is positioned between the first sealing ring 331 and the second sealing ring 332. The recessed area 333 is positioned to be aligned with a fluid port, such as a first reusable hydraulic port 203 when the sealing element is installed in a rotating control device. This alignment results in the formation of an enclosed, sealed volume that is fluidly isolated by the first sealing ring 331, second sealing ring 332, external surface 323, and an internal surface of the rotating control device in which the seal bore protector 320 is installed.

Figure 4A:
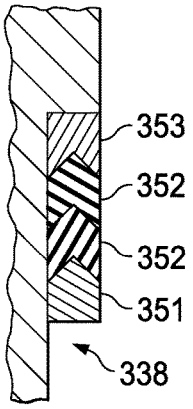
FIG. 4A is a detail, section view of a sealing ring, as indicated by the callout of FIG. 4.

The first reusable hydraulic port 203, shown here for reference, is part of the outer stationary body of a rotating control device. In FIG. 4 for example, the illustration of first reusable hydraulic port 203 shows how the first reusable hydraulic port 203 lines up with the recessed area 333 between the first ring 331 and the second ring 332 of the sealing element 330. The recessed area 333 is fluidly coupled to the first reusable hydraulic port 203 when the seal bore protector 320 is installed in a rotating control device. As shown in more detail in FIG. 5, the first sealing ring 331 and the second sealing ring 332 are each made up of three elastomer bands. Alternatively, the sealing ring 331 and second sealing ring 332 may each be a single elastomer band or a plurality of elastomer bands that may include bands having different shapes, sizes, and materials. These elastomer bands may be held in place by being fused together, stacked together, held by a shape of the external surface 323, a placement of the elastomer bands on the external surface 323, or by being mechanically interlocked with each other based on a cross sectional shape of the bands. For example, the sealing ring 331 and the second sealing ring 332 may be V-stacking seals. As such, each of the elastomer bands 352 that make up the sealing ring 331 and second sealing ring 332 may include members having a cross sectional chevron shape that can stack into similarly shaped elastomer bands 352, with complementary male hands 351 and female bands 353 on opposing ends (see FIG. 4A).

Similar to the first sealing element 330, a second sealing element 335 is included around the external surface 323 of the cylindrical body 321 of the seal bore protector 320. The second sealing element 335 is positioned toward an opposite end of the seal bore protector 320 from the sealing element 330. The second sealing element 335 includes a third sealing ring 336 and a fourth sealing ring 337. The second sealing element 335 of the seal bore protector 320 has a second recessed area 338 between the third sealing ring 336 and the fourth sealing ring 337. The second recessed area 338 is fluidly coupled with another port of the outer stationary body of a rotating control device when the seal bore protector 320 is installed in the rotating control device.

Figure 5:
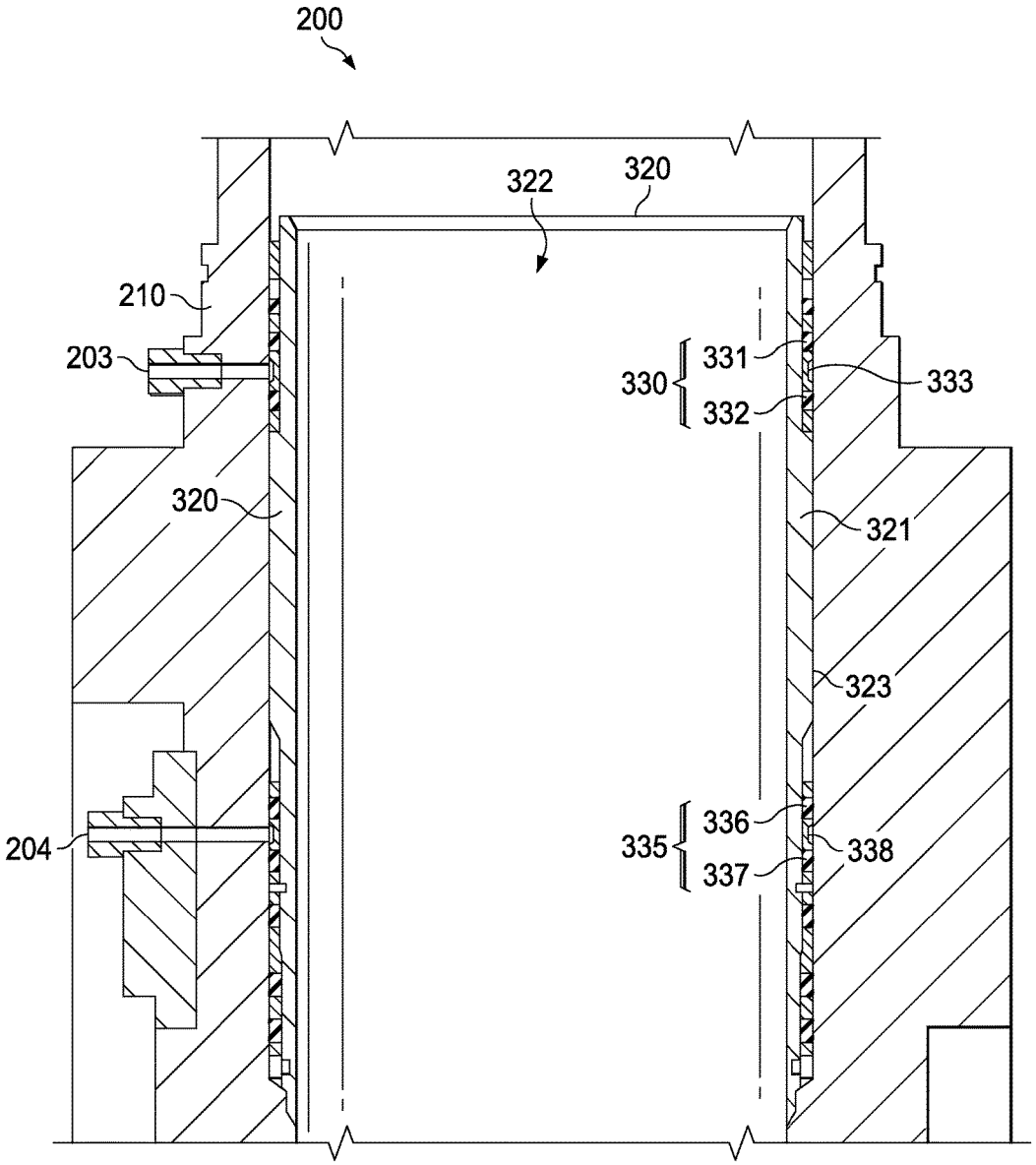
FIG. 5 is a schematic, cross-section view of a portion of a rotating control device and an installed seal bore protector.

FIG. 5 shows the rotating control device 200 with a seal bore protector 320 installed and actuated to be in an engaged position in which the sealing elements are in an energized state. The seal bore protector 320 is installed and secured in place by frictional forces generated by energized sealing elements 330, 335. The seal bore protector 320 can be positioned inside of the outer stationary body 210 of the rotating control device 200 such that the seal bore protector 320 covers, isolates, and protects portions of an inner surface of the rotating control device 200 from any tubing string and/or components that pass through the rotating control device 200. When actuated, the one or more sealing elements 330, 335 radially expand when subjected to hydraulic pressure generated through the first hydraulic port 203 and second hydraulic port 204, respectively. This expansion causes the sealing elements 330, 335 to exert a radial force on the inner surface of the outer stationary body 210 of the rotating control device 200, in turn resulting in a frictional force that longitudinally secures the seal bore protector 320 relative to the inner surface of the outer stationary body 210 of the rotating control device 200.

In another embodiment, the one or more sealing elements 330, 335 may be energized such that they substantially maintain their shape while providing a constant sealing frictional force between the external surface 323 of the seal bore protector 320 and the inner surface of the stationary body of the rotating control device.

As described above with regard to FIG. 4, each of the sealing elements 330, 335 may be composed of a number of smaller sealing rings. When the seal bore protector is installed, the sealing elements 330, 335 form sealed volumes 333, 338 between sealing rings 331 and 332 and between sealing rings 336 and 337. The sealed volumes 333, 338 are fluidly coupled to the first hydraulic port 203 and second hydraulic port 204. The first hydraulic port 203 and second hydraulic port 204 each provide a pressurized fluid to the sealed areas 333, 338, which energizes the sealing rings 331, 332, 336, 337 and thereby increases the frictional forces that retain the seal bore protector 320 within the rotating control device 200.

In some embodiments, the sealed volume 333 may comprise a recessed area or groove that is positioned between the first sealing ring 331 and the second sealing ring 332. The recessed area or groove is positioned to be aligned with a fluid port, such as the first hydraulic port 203 when the sealing element is installed. This alignment results in the formation of an enclosed, sealed volume that is fluidly isolated by the first sealing ring 331, second sealing ring 332, external surface 323, and an internal surface of the rotating control device in which the seal bore protector 320 is installed. A second sealed volume 338 may include a similar recessed area or groove.

As shown in the above embodiments, a seal bore protector may be generally cylindrical and include one or more sealing elements. For example, for every fluid port of the rotating control device, a corresponding sealing element can be provided on an external surface of a seal bore protector to create a sealed volume that can be pressurized to increase frictional engagement.

Each sealing element may include two sealing rings to facilitate formation of a sealed area between the rings. In one or more embodiments a cross-sectional shape of the rings may be circular, rectangular, triangular, or a variety of other shapes depending on the shape of the external surface of the seal bore protector and the inner surface of the stationary body of the rotating control device. Similarly, the cross-sectional shape and general dimensions of the recessed area can be varied depending on the desired amount of fluid and pressure the sealing element is to provide. Each ring can be made of multiple bands as described above or may be made from a single shaped band. Further, each band can be made from the same elastomer material or each can be made from different materials.

When the seal bore protector is installed, space vacated by the rotating bearing assembly is partially occupied by the seal bore protector, which provides a path into the wellbore having increased area relative to the bearing assembly. This increased area facilitates the attachment of the larger components to the drill/work string for deployment downhole. Simultaneously, the inner surface of the stationary body is isolated and protected from such components or other debris by the seal bore protector.

The particular embodiments disclosed above are illustrative only, and may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified, and all such variations are considered within the scope and spirit of the present invention.

For example, the illustrative embodiments may be better understood with regard to at least the following exemplary embodiments:

In a first exemplary embodiment, a seal bore protector includes a cylindrical body and a sealing element disposed around an external surface of the cylindrical body. A throughbore extends through the cylindrical body. The sealing element includes a first sealing ring, a second sealing ring; and a recessed area between the first sealing ring and the second sealing ring. The recessed area is positioned on the cylindrical body so as to align with a port of a rotating control device when installed.

The first sealing ring and second sealing ring may be made from an elastomeric material suitable for use in o-rings or v-stacking, or similar sealing devices. It follows that the first sealing ring may be formed from an o-ring positioned in a groove or v-stacking positioned adjacent a shoulder on the external surface of the cylindrical body.

In some instances, the sealing element is a first sealing element the seal bore protector includes one or more second sealing elements that are similarly positioned about the external surface of the cylindrical body. Each of the one or more second sealing elements is spaced longitudinally away from the first sealing element on the cylindrical body. The second sealing element includes a third sealing ring, a fourth sealing ring, and a second recessed area between the third sealing ring and the fourth sealing ring. When installed, the second recessed area is positioned to align with a second port of the rotating control device.

In a second exemplary embodiment, a rotating control device assembly includes an outer stationary body for receiving a removable inner rotating bearing assembly. In place of the removable inner rotating bearing assembly, the rotating control device includes a seal bore protector. The seal bore protector includes a cylindrical body having a throughbore extending there-through, and a sealing element disposed around an external surface of the cylindrical body. The sealing element includes a first sealing ring and a second sealing ring. The first sealing ring and second sealing ring define a sealed volume between the external surface of the cylindrical body and an internal surface of the outer stationary body. The sealed volume is fluidly coupled with a port of the outer stationary body. The port may be a hydraulic port that is configured to supply cooling fluid to, or remove cooling fluid from, a rotating bearing assembly.

In some embodiments, the first sealing ring and second sealing ring include an elastomeric material. Similarly, the first sealing ring and second sealing ring may be formed from a plurality of stacked elastomeric bands. The sealing element may be positioned at a first, upper end of the cylindrical body or a second, lower end of the cylindrical body.

In some embodiments, the sealing element is a first sealing element and wherein the seal bore protector further comprises a second one or more sealing elements disposed around the external surface of the cylindrical body toward an opposite end from the first sealing element. The second sealing element includes a third sealing ring and a fourth sealing ring that define a second sealed volume between the external surface of the cylindrical body and an internal surface of the outer stationary body. The second sealed volume is fluidly coupled with a second port of the outer stationary body, which may also be a hydraulic port that is conventionally used to supply fluid to a rotating bearing assembly or to remove fluid from the rotating bearing assembly.

In another exemplary embodiment, a method of protecting a seal bore of a rotating control device includes removing an inner rotating bearing assembly of the rotating control device from an outer stationary body of the rotating control device. The method also includes inserting a seal bore protector in place of the inner rotating bearing assembly into the outer stationary body of the rotating control device. The seal bore protector includes a first sealing ring and a second sealing ring, and the first sealing ring and second sealing ring define a sealed volume between an external surface of the seal bore protector and an internal surface of the outer stationary body. Further, the method includes aligning the sealed volume with a first hydraulic port of the rotating control device.

In some embodiments, the method includes providing a pressurized fluid to the sealed volume to energize the first sealing ring and second sealing ring. The first hydraulic port may be a cooling fluid inlet or a cooling fluid outlet. The first sealing ring and second sealing ring may be made from an elastomeric material, and each may include a plurality of stacked elastomeric bands. The seal bore protector may further include a third sealing ring and a fourth sealing ring that define a second sealed volume between the external surface of the seal bore protector and the internal surface of the outer stationary body. The second sealed volume is fluidly coupled with a second port of the outer stationary body. In such an embodiment, the aforementioned method may further include providing a pressurized fluid to the second sealed volume to energize the third sealing ring and the fourth sealing ring.

We claim:

1. A seal bore protector comprising:

a cylindrical body;

a throughbore extending through the cylindrical body; and a sealing element disposed around an external surface of the cylindrical body, wherein the sealing element comprises:

a first sealing ring;

a second sealing ring; and a recessed area between the first sealing ring and the second sealing ring, wherein the recessed area is positioned to align with a port of a rotating control device, wherein each of the first sealing ring and the second sealing ring comprise at least one intermediate member having a v-shape, the at least one intermediate member being positioned between a male band on a first side and a female band on a second, opposing side, and wherein each of the first sealing ring and the second sealing ring are operable to exert a radial force and form an energized seal between the cylindrical body and an interior surface of the rotating control device in response to a pressurized fluid being supplied through the port to the recessed area.

2. The seal bore protector of claim 1, wherein the first sealing ring and the second sealing ring comprise an elastomeric material.

3. The seal bore protector of claim 1, wherein the sealing element is a first sealing element, and further comprising:

a second sealing element disposed around the external surface of the cylindrical body and spaced longitudinally away from the first sealing element, wherein the second sealing element comprises:

a third sealing ring;

a fourth sealing ring; and a second recessed area between the third sealing ring and the fourth sealing ring, and wherein the second recessed area is positioned to align with a second port of the rotating control device.

4. A rotating control device assembly comprising:

an outer stationary body for receiving a removable inner rotating bearing assembly; and a seal bore protector comprising:

a cylindrical body having a throughbore extending there-through; and a sealing element disposed around an external surface of the cylindrical body, wherein the sealing element includes a first sealing ring and a second sealing ring, the first sealing ring and the second sealing ring defining a sealed volume between the external surface of the cylindrical body and an internal surface of the outer stationary body, wherein the sealed volume is fluidly coupled with a port of the outer stationary body, wherein each of the first sealing ring and the second sealing ring comprise at least one intermediate member having a v-shape, the at least one intermediate member being positioned between a male band on a first side and a female band on a second, opposing side, and wherein each of the first sealing ring and the second sealing ring are operable to exert a radial force and form an energized seal between the cylindrical body and the internal surface of the outer stationary body in response to a pressurized fluid being supplied through the port to the sealed volume.

5. The rotating control device assembly of claim 4, wherein the port comprises a hydraulic port.

6. The rotating control device assembly of claim 4, wherein the first sealing ring and the second sealing ring comprise an elastomeric material.

7. The rotating control device assembly of claim 4, wherein the first sealing ring comprises a plurality of stacked elastomeric bands.

8. The rotating control device assembly of claim 4, wherein the sealing element is positioned at a first, upper end of the cylindrical body.

9. The rotating control device assembly of claim 4, wherein the sealing element is positioned at a second, lower end of the cylindrical body.

10. The rotating control device assembly of claim 4, wherein the sealing element is a first sealing element and wherein the seal bore protector further comprises:

a second sealing element disposed around the external surface of the cylindrical body toward an opposite end from the first sealing element, wherein the second sealing element includes a third sealing ring and a fourth sealing ring, the third sealing ring and the fourth sealing ring defining a second sealed volume between the external surface of the cylindrical body and the internal surface of the outer stationary body, and wherein the second sealed volume is fluidly coupled with a second port of the outer stationary body.

11. The rotating control device assembly of claim 9, wherein the outer stationary body is a pressure shell.

12. A method of protecting a seal bore of a rotating control device, the method comprising:

removing an inner rotating bearing assembly of the rotating control device from an outer stationary body of the rotating control device;

inserting a seal bore protector in place of the inner rotating bearing assembly into the outer stationary body of the rotating control device, the seal bore protector including a first sealing ring and a second sealing ring, the first sealing ring and the second sealing ring defining a sealed volume between an external surface of the seal bore protector and an internal surface of the outer stationary body;

aligning the sealed volume with a first hydraulic port of the rotating control device;

actuating the first sealing ring and the second sealing ring by providing a pressurized fluid through the port to the sealed volume to energize the first sealing ring and the second sealing ring against the external surface of the seal bore protector and the internal surface of the outer stationary body; and passing at least a portion of a drill string through the seal bore protector while the first sealing ring and the second sealing ring remain actuated.

13. The method of claim 12, wherein the first hydraulic port is a cooling fluid inlet.

14. The method of claim 12, wherein the first hydraulic port is a cooling fluid outlet.

15. The method of claim 12, wherein the first sealing ring and the second sealing ring comprise an elastomeric material.

16. The method of claim 12, wherein the first sealing ring comprises a plurality of stacked elastomeric bands.

17. The method of claim 12, wherein the seal bore protector further comprises:

a third sealing ring and a fourth sealing ring, the third sealing ring and the fourth sealing ring defining a second sealed volume between the external surface of the seal bore protector and the internal surface of the outer stationary body, wherein the second sealed volume is fluidly coupled with a second port of the outer stationary body, and wherein the method further comprises providing a pressurized fluid through the second port to the second sealed volume to energize the third sealing ring and the fourth sealing ring against the external surface of the seal bore protector and the internal surface of the outer stationary body.

* * * * *